US005539978A

United States Patent [19]

Vanbesien

[11] Patent Number: 5,539,978

[45] Date of Patent: Jul. 30, 1996

[54] METHOD FOR PRODUCING GROUPS OF CONTACT ELEMENTS FOR PLUG CONNECTORS

[75] Inventor: Johan Vanbesien, Izegem, Belgium

[73] Assignee: Siemens Aktiengesellschaft, Munich, Germany

[21] Appl. No.: 312,314

[22] Filed: Sep. 26, 1994

[30] Foreign Application Priority Data

Sep. 24, 1993 [DE] Germany ..... 43 32 636.6

[51] Int. Cl.[6] ..... H01K 43/00

[52] U.S. Cl. ..... 29/884; 29/885; 439/885; 439/886

[58] Field of Search ..... 439/885, 886, 439/608; 29/884, 885

[56] References Cited

U.S. PATENT DOCUMENTS

| | | | |
|---|---|---|---|
| 4,764,645 | 8/1988 | Takasawa | 29/884 |
| 5,104,341 | 4/1992 | Gilissen et al. . | |
| 5,152,700 | 10/1992 | Bogursky et al. | 439/885 X |
| 5,175,928 | 1/1993 | Grabe | 29/884 |
| 5,201,883 | 4/1993 | Atoh et al. | 29/884 X |

FOREIGN PATENT DOCUMENTS

| | | |
|---|---|---|
| 0422785 | 4/1991 | European Pat. Off. . |
| 9013007 | 1/1991 | Germany . |
| 4040551 | 6/1991 | Germany . |

*Primary Examiner*—Carl J. Arbes
*Attorney, Agent, or Firm*—Herbert L. Lerner; Laurence A. Greenberg

[57] ABSTRACT

A method for producing groups of contact elements for 90°-angle plug connectors by the press-in technique, includes forming the contact elements with a stamping device into a contact region on a plug side having a plugging direction, a terminal region on a terminal side, the terminal region having a press-in segment extending at right angles to the plugging direction, and connecting struts joining the press-in segment to the contact region. Different cutting tools are inserted into the stamping device to produce groups with a different number of contact elements. Different connections are stamped between the contact regions and the terminal regions of certain contact elements with the cutting tools. A plug connector is partially equipped with only a certain number of contact elements of an applicable group with one cutting tool, by stamping the connections between a given number of the contact regions and the given number of the terminal regions of intended contact elements, and trimming off excess contact and terminal regions of unused contact elements of the applicable group with the applicable cutting tool at the same time that the different connections are produced.

4 Claims, 4 Drawing Sheets

METHOD FOR PRODUCING GROUPS OF CONTACT ELEMENTS FOR PLUG CONNECTORS

BACKGROUND OF THE INVENTION

1. Field of the Invention

The invention relates to a method for producing groups of contact elements for 90°-angle plug connectors by the press-in or impression technique, in which the contact elements, in a stamping device, are constructed on a plug side with a contact region and on a terminal side with a terminal region having a press-in or impression segment extending at right angles to the plugging direction and being joined to the contact region through connecting struts.

German Utility Model DE-GM 90 13 007 discloses a plug connector that is formed by a main body of insulating material, acting as a contact strip, and an additional body of insulating material carrying contact elements. It is surrounded by a sheet-metal covering, and is secured to a printed wiring board by the press-in or impression technique. Each of the contact elements is disposed one above the other in a gap and provided on the plug side with a contact region having a contact spring and on the terminal side with a terminal region extending at right angles to the plugging direction. The latter region has a press-in or impression pin and is joined to the contact region through connecting struts. Such contact elements can be made in a stamping device.

German Published, Non-Prosecuted Application DE 40 40 551 A discloses a connector configuration with a number of individual sub-configurations of terminals that are parallel to one another. The sub-configurations are insulating carriers of the contact elements that protrude with plug regions thereof into housing modules.

The contact elements are constructed with a resiliently yielding segment in the terminal region thereof protruding out of the sub-configurations of terminals at right angles to the plugging direction. The terminal region and the plug region of the contact elements are joined together through connecting struts. The contact elements are disposed one above the other and are produced as a group by stamping of a terminal conductor frame. As is quite usual, in the known plug connectors, four or five contact elements that are disposed vertically one above the other in one column each form one group, in which each contact region of a contact element is fixedly associated with a certain terminal region and is always joined to that terminal region through the applicable connecting strut. Nevertheless, there are applications of plug connectors in which fewer contacts are needed, or greater contact spacings are desired. In such cases, a plug connector is then not equipped with five rows of contacts, for instance, but is only partially equipped, for instance with only three rows of contacts. In the known plug connectors with contact elements in four or five rows, that means that with a group of five contact elements disposed in one column, for instance, the contact and terminal regions of the unneeded contacts, for instance contacts 2 and 4, are removed. However, since the other contacts that are needed or desired have contact and terminal regions being fixedly associated with one another, which in such an example are contacts 1, 3 and 5, the plug connector requires the same amount of installation space on a printed wiring board as a plug connector that is fully equipped with five rows, for instance, despite being only partially equipped. When a plug connector that is constructed for five rows of contacts, for instance, is only partially equipped, for instance with only three rows of contacts, then if the space required on the printed wiring board is to be reduced, either new contact elements, or contact elements with new connections, are needed.

Until now, different connections have been made by different stamping and bending operations.

SUMMARY OF THE INVENTION

It is accordingly an object of the invention to provide a method for producing groups of contact elements for plug connectors, which overcomes the hereinafore-mentioned disadvantages of the heretofore-known methods of this general type, which assures economical manufacture of the contact elements when a plug connector is partially equipped and which results in a reduced space requirement when the plug connector is installed on a printed wiring board.

With the foregoing and other objects in view there is provided, in accordance with the invention, in a method for producing groups of contact elements for 90°-angle plug connectors by the press-in technique, which includes forming the contact elements with a stamping device into a contact region on a plug side having a plugging direction, a terminal region on a terminal side, the terminal region having a press-in segment extending at right angles to the plugging direction, and connecting struts joining the press-in segment to the contact region, the improvement which comprises exchanging and inserting different cutting tools into the stamping device to produce groups with a different number of contact elements; stamping different connections between the contact regions and the terminal regions of certain contact elements with the cutting tools; and partially equipping a plug connector with only a certain number of contact elements of an applicable group, each with one cutting tool, by stamping the connections between a given number of the contact regions and the given number of the terminal regions of intended contact elements, and trimming or stamping off excess contact and terminal regions of unused contact elements of the applicable group with the applicable cutting tool at the same time that the different connections are produced.

In such a method, different contact elements are all produced in the same production operation by means of the same cutting tool that can be inserted into the stamping device. Different connections between the contact and terminal regions are stamped out once and for all, and excess contacts and terminals are also trimmed away in the process. Several passes through complex tools are thus eliminated. Moreover, with a method of this kind, the connection configuration between the contact and terminal regions can be variable to a wide extent, so that when a plug connector is partially equipped with fewer than the usual number of rows of contacts, the space required on the terminal side of a plug connector on a printed wiring board is also reduced.

In accordance with another mode of the invention, the different connections between the contact and terminal regions of certain contact elements are produced in a simple manner by a die package, each being formed of a plurality of dies.

In accordance with a further mode of the invention, the applicable cutting tool is inserted into the stamping tool into an intermediate region between the contact regions and the connecting struts of the contact elements. In this way, regardless of whether plug connectors are fully or partially equipped, the structure of different contact elements in the contact and terminal regions, including the connecting struts, remains unchanged when various groups of contact elements are produced, since with different contact elements, only the intermediate region between the contact regions and the connecting struts are ever modified and stamped differently.

In accordance with a concomitant mode of the invention, with respect to the space required on the terminal side of only partially equipped plug connectors, the connections of contact regions of certain contact elements are produced on the terminal side with successive terminal regions. In that case, if a plug connector is partially equipped, for instance with only three rows of contacts instead of five for a full set, only the least possible space requirement is needed on the terminal side. This amount of space is determined by the number of terminals which are located directly side by side and correspond to the number of partially equipped contacts. With partial equipping in three rows, for instance, the space requirement is equivalent to three terminals located directly side by side.

Other features which are considered as characteristic for the invention are set forth in the appended claims.

Although the invention is illustrated and described herein as embodied in a method for producing groups of contact elements for plug connectors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
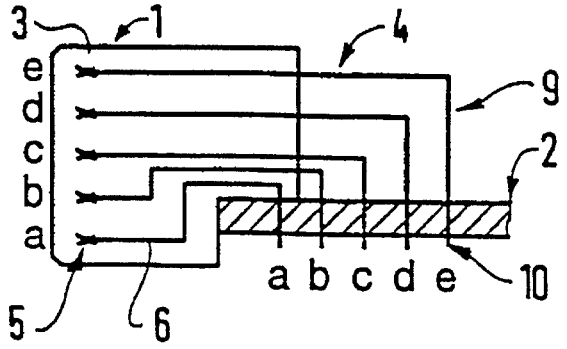
FIG. 1 is a fragmentary, diagrammatic, partly sectional, side-elevational view showing a layout of a typical plug connector that is fully equipped with five rows of contacts a through e.

Referring now to the figures of the drawing in detail and first, particularly, to FIG. 1 thereof, there is seen a plug connector 1 which is a 90°-angle plug connector, that is secured to a printed wiring board 2 and contacted by the press-in, impression or insertion technique. The plug connector 1 has a contact strip 3 that is made of insulating material and is constructed either as a knife-like strip with pin-like knife contacts or as a spring strip with bush-like contact springs. In either case, contact elements 4 are disposed in the contact strip 3 in rows that are parallel to one another and columns that are parallel to one another. In the illustrated exemplary embodiment, the contact strip 3 is constructed on the plug side with chambers for contact springs 5 and thus it is in the form of a spring strip. In this case, there are five chambers in each column, disposed vertically one below the other. As an example, 17 columns may be provided, which then results in a spring strip with five rows and 17 columns, therefore forming an 85-pin plug connector. The contact elements 4 that are disposed in one column form one group, which is made in a stamping device.

Figure 2:
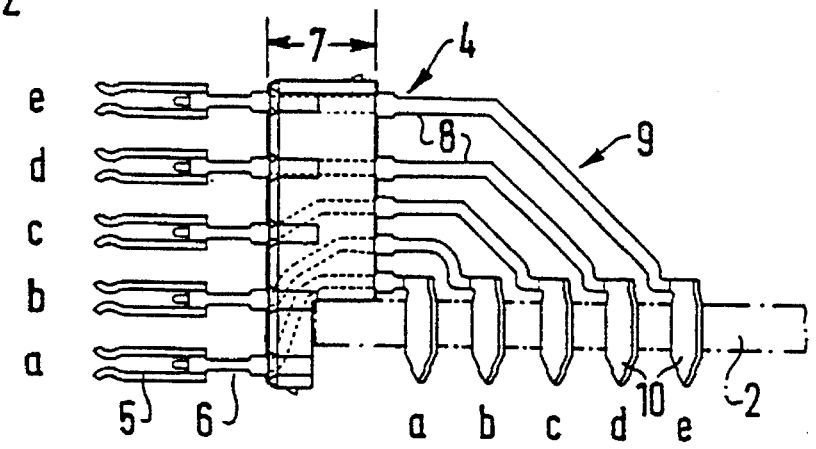
FIG. 2 is a side-elevational view showing a group of five contact elements for a plug connector of FIG. 1 that are disposed in one column and are embedded in plastic in a partial region.

The contact elements 4 are constructed on the plug side with a contact region 6 having a contact zone cooperating with a counterpart plug element. As is seen in FIG. 2, in the contact zone the contact region 6 has the contact springs 5 and it is joined to connecting stems or struts 8 of a terminal region 9 through an intermediate region 7 that is embedded in plastic. The terminal region 9 has a press-in or impression segment 10 extending at right angles to the plug direction and being constructed in the terminal zone at the printed wiring board as an elastically resilient press-in or impression pin, for instance.

The five contact elements 4 of the group, and therefore all of the contact elements within one row, in each case are all designated on both the plug side and the terminal side by letters a, b, c, d and e. FIGS. 1 and 2 show that a contact region 6 that is identified with a certain letter on the plug side, in each case is joined to the terminal region 9 being identified by the same letter. Thus the contact spring 5 in one column which is identified by the letter a, is connected to the terminal zone a on the terminal side. The same is true in the same way for the other contact elements and therefore for all of the contact elements of the plug connector that are disposed in one row. Therefore, the space required on the printed wiring board 2 on the terminal side for a plug connector that is fully equipped with five rows of contacts, is necessarily the same as the space required for the five-row configuration a through e.

Figure 3:
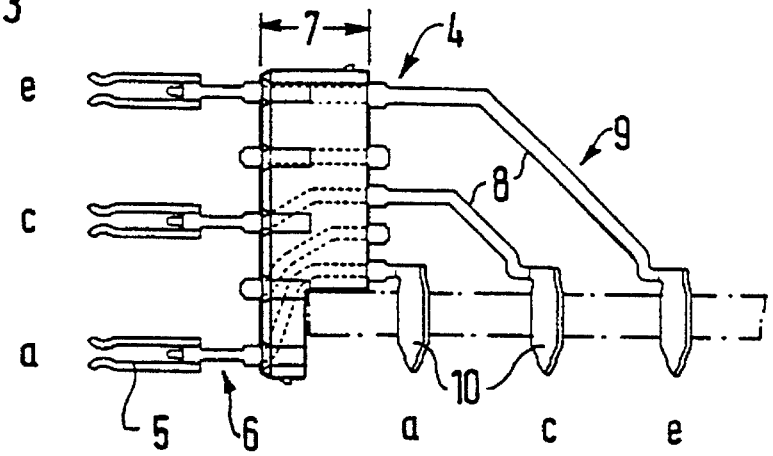
FIGS. 3 and 4 are side-elevational views each showing one partially equipped group, embedded in plastic, having only three and two contact elements, respectively.
Figure 4:
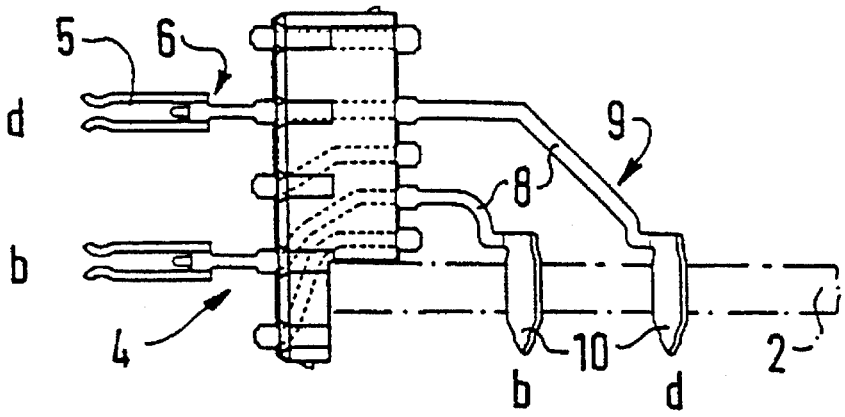

In the case where the plug connector is partially equipped, for instance with only three rows of contacts a, c, e as is seen in FIG. 3 or with two rows of contacts b and d as is seen in FIG. 4, the contact and terminal regions of the unneeded contacts are then to be removed, or in other words the regions b and d in the case of FIG. 3 and the regions a, c and e in the case of FIG. 4 are to be removed. However, due to the fixed association of the contact and terminal regions, even in the case of partial equipping, the space for the five-row configuration a through e is still required on the terminal side in FIG. 3 and the space for a four-row configuration a through d is still required in FIG. 4. If the plug connector is partially equipped, for instance with three contact rows a, c and e, then the space requirement on the printing wiring board 2, or in other words on the terminal side, can be reduced by joining the contact regions 6 of rows a, c and e on the terminal side to the terminal regions 9 of the rows a, b and c, as is shown in FIG. 5.

However, to that end, in other words to reduce the terminal-side space requirement with arbitrary partial equipping of a plug connector, it is necessary to produce different connections. In order to avoid making them expensively by means of separate stamping operations, the method of the invention provides that groups with a different number of contact elements are made by inserting different cutting tools into the stamping device. Through the use of these cutting tools, different connections between the contact regions and the terminal regions of certain contact elements are stamped. In order to partially equip a plug connector with only a certain number of contact elements of the applicable group, the connections between the contact regions and a number of terminal regions of the contact elements that corresponds to the number of these contact regions are merely stamped with the same such cutting tool.

Figure 5:
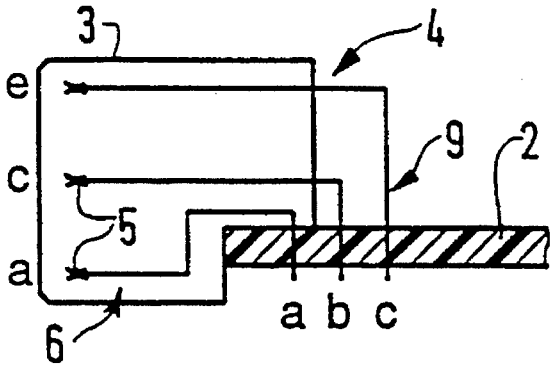
FIGS. 5 and 6 are views similar to FIG. 1 showing a plug connector equipped with only three rows of contacts a, c and e.
Figure 6:
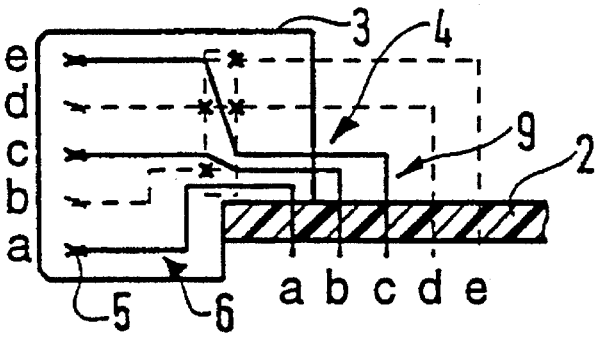

As is apparent in FIG. 6, the excess contact and terminal regions of the unused contact elements of the applicable group are trimmed away from the regions of the contact rows b and d shown in dashed lines that are not occupied in FIG. 5. The trimming is done by the applicable cutting tool simultaneously with the production of such different connections. This method will be described in further detail below in terms of partially equipped groups of contact elements with different connections, as is shown in FIGS. 7–11.

Figure 7:
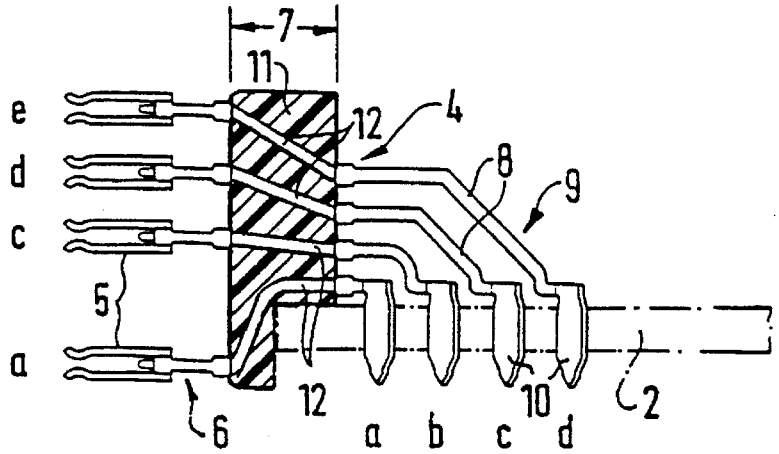
FIGS. 7–11 are partly sectional, side-elevational views each showing partially equipped groups having a different number of contact elements for a plug connector, wherein the groups of contact elements are made by the method of the invention.

In all cases, the different connections are each made by a cutting tool in the form of a die package 11 formed of a plurality of dies. The individual cutting dies have different shapes and are each indicated by slanted shading in FIGS. 7–11. Accordingly, the die package 11 is always inserted into the stamping tool and into the intermediate region 7 that joins together the contact regions 6 and the connecting stems or struts 8 and that later will be embedded in plastic, and is constructed in such a way that in the stamping operation, the intermediate region is trimmed away except for the connections that are required. In the embodiment of FIG. 7, the group is occupied only with the contact elements of rows a, c, d and e. Their contact regions 6 are joined on the terminal side to rows a, b, c and d, by constructing the die package 11 and its individual dies in such a way that in the stamping operation, four corresponding connections 12 are created between the plug and the terminal sides. In this case, row a on the plug side is joined to row a on the terminal side; row c on the plug side is joined to row b on the terminal side; row d on the plug side is joined to row c on the terminal side; and row e on the plug side is joined to row d on the terminal side. In other words, in that case a connection of the plug-side rows a, c, d and e is made with the four successive rows a, b, c and d on the terminal side, so that in the case of a four-row group, the space required on the terminal side is only that for four rows.

Figure 8:
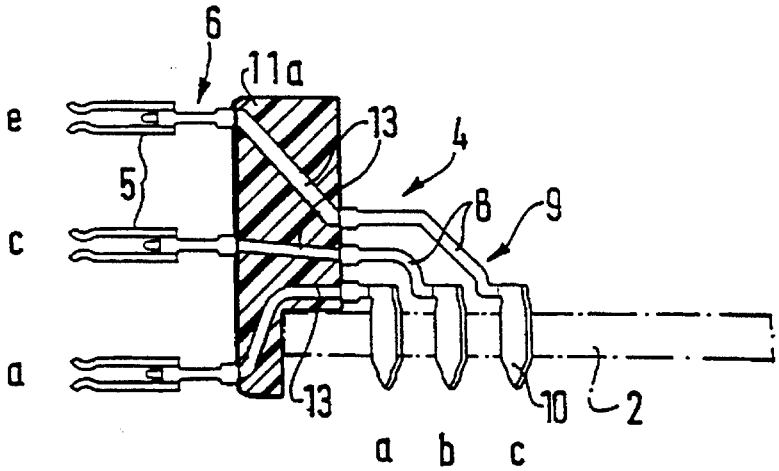
Figure 9:
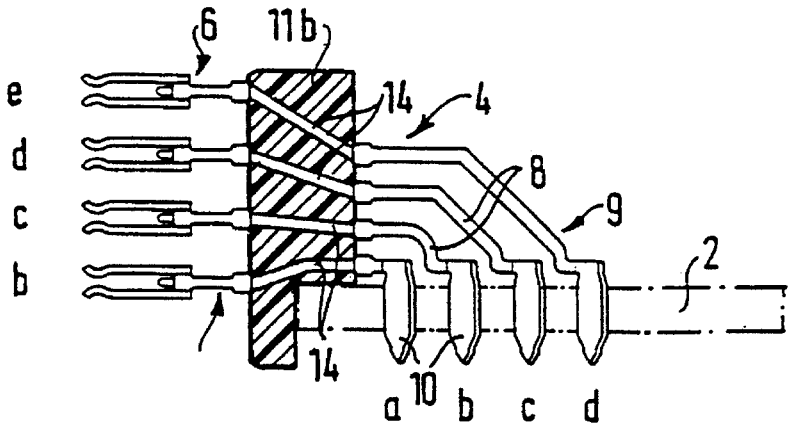
Figure 10:
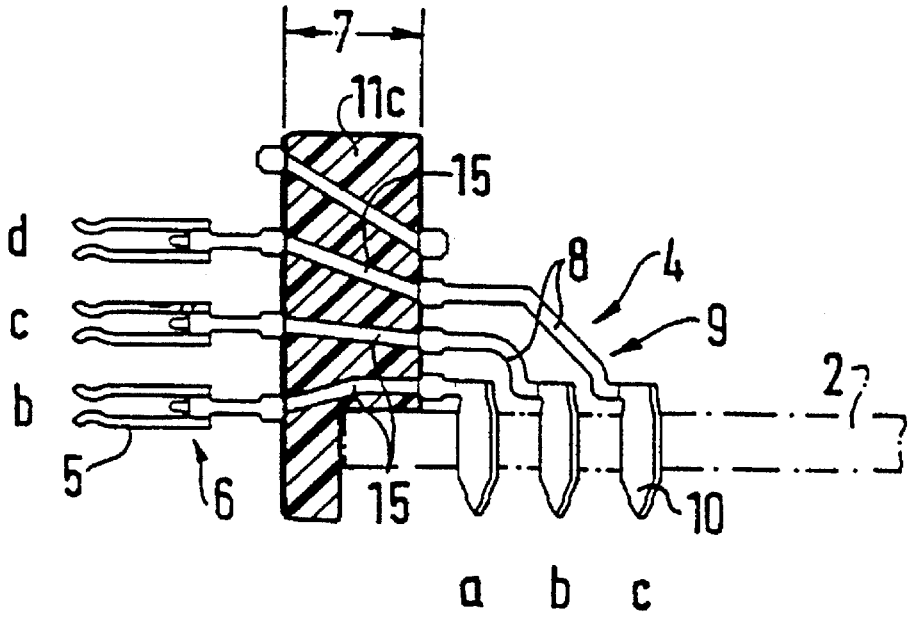
Figure 11:
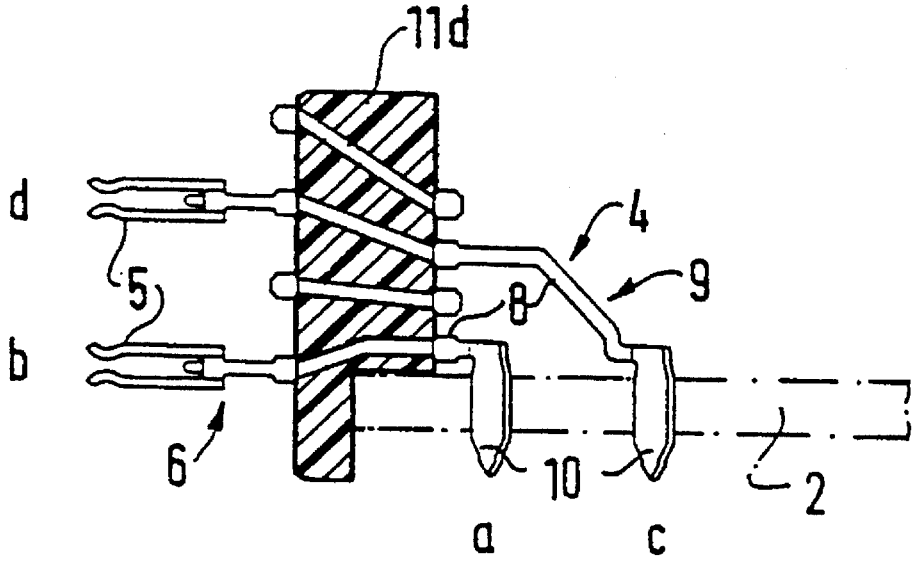

The situation is correspondingly the same for the embodiments shown in FIGS. 8–10. In FIG. 8, a three-row group of contact elements is provided, having plug-side rows a, c and e that are joined on the terminal side to the successive rows a, b and c through corresponding connections 13 made in the stamping operation. The individual dies of a die package 11*a* are constructed in this case in such a way that the three connections a-a, c-b and e-c are made between the plug and terminal sides. In the case of the four-row contact element group in FIG. 9, a die package 11*b* makes four connections 14 between the plug and terminal sides, namely the four connections b-a, c-b, d-c and e-d between the plug and terminal sides. The three-row contact element group in FIG. 10 has three connections 15, namely the connections b-a, c-b and d-c, which are trimmed away from the intermediate region 7 by means of a die package 11*c*, for instance. However, it is also possible to form the contact element group in FIG. 10 from the contact element group in FIG. 9 by removing rows e and d. In the contact element group in FIG. 10, the lesser space requirement on the terminal side of the printed wiring board 2 is clearly apparent as compared with the three-row configuration of FIG. 3. In contrast to FIGS. 7–10, In the two-row contact element group shown in FIG. 11, the plug-side rows b and d, are not connected to successive rows on the terminal side, but rather to row a and row c. Nevertheless, the terminal-side space requirement in this case is less than in the configuration of FIG. 4 which likewise has two rows. The contact element group in FIG. 11 can be made by means of a die package 11*d* or can be obtained from the contact element group in FIG. 9. The reduction in the space requirement for all of the contact element groups of FIGS. 7–11 is advantageously achieved by means of the variable connections 12–15 produced by the method of the invention.

I claim:

1. In a method for producing groups of contact elements for 90°-angle plug connectors by the press-in technique, which includes forming the contact elements with a stamping device into a contact region on a plug side having a plugging direction, a terminal region on a terminal side, the terminal region having a press-in segment extending at right angles to the plugging direction, and connecting struts joining the press-in segment to the contact region, the improvement which comprises:

selectively inserting different cutting tools into the stamping device to produce groups with a different number of contact elements;

stamping different connections between the contact regions and the terminal regions of certain contact elements with the cutting tools; and partially equipping a plug connector with only a certain number of contact elements of an applicable group with one applicable cutting tool, by stamping the connections between a given number of the contact regions and the given number of the terminal regions of intended contact elements, and trimming off excess contact and terminal regions of unused contact elements of the applicable group with the applicable cutting tool at the same time that the different connections are produced.

2. The method according to claim 1, which comprises producing each of the different connections with a die package formed of a plurality of dies.

3. The method according to claim 1, which comprises inserting the applicable cutting tool in the stamping device into an intermediate region between the contact regions and the connecting struts joining the press-in segment to the contract region.

4. The method according to claim 1, which comprises producing the connections of the contact regions of certain contact elements on the terminal side with successive terminal regions.

* * * * *